United States Patent [19]

Sharp

[11] Patent Number: 4,477,006

[45] Date of Patent: Oct. 16, 1984

[54] OFFSET PIVOT GUIDING ASSEMBLY

[75] Inventor: Mark E. Sharp, Oklahoma City, Okla.

[73] Assignee: Robert L. Fife, Vancouver, Wash.

[21] Appl. No.: 471,763

[22] Filed: Mar. 3, 1983

[51] Int. Cl.[3] ..... B65H 25/26

[52] U.S. Cl. ..... 226/18; 226/21

[58] Field of Search ..... 226/3, 15, 18, 19, 20, 226/21–23, 198; 242/76, 57, 57.1; 248/652, 664, 665

[56] References Cited

U.S. PATENT DOCUMENTS

| | | | |
|---|---|---|---|
| 2,821,387 | 1/1958 | Faeber | 226/3 |
| 3;171,579 | 3/1965 | Robertson | 226/23 |
| 3,425,608 | 2/1969 | Lembo | 226/19 |
| 3,599,849 | 8/1971 | Callan | 226/22 |
| 3,942,696 | 3/1976 | Pira et al. | 226/21 |

OTHER PUBLICATIONS

P. 27 of brochure by North American Mfg., Co., Oct. 1982.

P. 81 of brochure by Fife Corp., Sep. 1982.

*Primary Examiner*—Leonard D. Christian

[57] ABSTRACT

A guide frame has overlying support on a base frame and supports a pair of spaced, parallel guide rollers arranged with their axes extending across the line of travel of a moving web. These rollers receive the traveling web over the surface thereof from an entering span at one of the rollers and an exiting span at the other roller, the span between the rollers comprising a guide movement span. A fixed offset pivot supports the guide frame pivotally on the base frame in an area adjacent to the entering span of the rollers. This fixed pivot support is rigid in a direction parallel with the pivot axis but has some flexibility in the direction of travel of the guide movement span of the web. A movable pivot support supports the guide frame on the base frame in an area adjacent the exiting span of the rollers. This movable pivot support has a movable portion confined to linear movement, with the relative travel between the linear movement thereof and the arc of the fixed pivot support being absorbed by a flexure in the fixed pivot support. An actuator is mounted on the base frame and is operatively secured to the movable portion of the movable pivot for driving it in the linear movement, comprising an adjusting movement of the guide frame for laterally positioning the traveling web.

10 Claims, 6 Drawing Figures

OFFSET PIVOT GUIDING ASSEMBLY

BACKGROUND OF THE INVENTION

This invention relates to new and useful improvements in offset pivot displacement-type guiding assemblies.

Displacement-type guiding assemblies are installed at intermediate guiding locations and used to control the lateral position of moving webs of material, such as paper, plastics, textiles and other flexible material being processed in continuous or roll form. These guiding assemblies are generally controlled by automatic control systems which employ a sensor that monitors the lateral web position immediately following the guiding assembly. As the web moves laterally at the sensor, a signal is generated which is transmitted to a servo mechanism which controls an actuator means connected to the guiding assembly. The guiding assembly provides continuous automatic lateral positioning of the moving web, thus closing the loop of the control system.

Displacement guides are used for guiding installations requiring excessive correction with minimum material spans entering and exiting the guide assembly. The entering and exiting web spans should be parallel to each other and perpendicular to the plane of guide motion.

It is desired that the positioning means be highly responsive to the driven power from the actuator whereby the web is quickly and accurately corrected in its path of movement into processing equipment. Such correction requires an adjustment of the positioning means, such as intermediate guides or unwinding and rewinding guiding assemblies. In order to accomplish such alignment, pivoted roller supporting frames have been used that have a drive connection with the actuator by pin connections, intermediate linkages, clevises, and other known connectors. This type of connector, however, has disadvantages in that it develops considerable friction and requires dimensional clearances. Such friction and dimensional clearances can cause lack of response and instability of the control system.

It is also desired that the positioning means be simplified in structure and operation, economical to manufacture and easy to maintain. Furthermore, it is desired that it be horizontally and vertically stable so as to provide a good support for the web passing over it. Such stability is also desired of course through the adjusting movement. Good support for the positioning means can be provided by large pivot bases or outboard supports, but this type of support adds undesirable friction drag to adjustable movement and of course also adds to the overall cost of the apparatus.

SUMMARY OF THE INVENTION

According to the instant invention and forming a primary objective thereof, an offset pivot displacement-type guiding assembly is provided that utilizes an improved pivot support for the web positioning means because it absorbs linkage dimensional clearances, allowing a high response frequency from an actuator means; that allows rigid mounting of actuator means, eliminating dimensional clearances required by pivoting actuators using clevis bracket and pins; and that allows usage of parallel mounting of raceway carrier assembly and actuator means, thus reducing overall assembly alignment problems prevalent when using outboard supports and carriers.

Another object is to provide an offset pivot displacement-type guiding assembly that, in addition to providing the above efficient response, has stable support in the plane of the web.

Other objects of the invention are to provide a guiding assembly of the type described that is simplified in structure, economical to manufacture and easy to maintain.

In carrying out the objectives of the invention, the offset pivot displacement-type guiding assembly includes a base frame and a guide frame overlying the base frame and having a pair of spaced, parallel guide rollers arranged with their axes extending across the line of travel of a moving web and capable of receiving a traveling web over the surface thereof from an entering span at one of said rollers and an exiting span at the other of said rollers. The span between the rollers comprises a guide movement span which can be laterally adjusted by adjustment of the guide frame in the plane of the web. A fixed offset pivot support on the base frame supports the guide frame thereon in an area adjacent the entering span of the rollers. This fixed pivot support provides stable mounting of the guide frame in a direction parallel with the pivot axis but is somewhat flexible in the direction of travel of the guide movement span of the web. The assembly also includes a movable pivot support which supports the guide frame on the base frame in an area adjacent to the exiting span of the rollers. The movable pivot support has a movable portion confined to linear movement, with the relative travel between the linear movement thereof and the arc of the fixed pivot support being absorbed by a flexure in the fixed pivot support. Actuator means are mounted on the base frame and are operatively secured to the movable portion of the movable pivot support for driving such movable portion in the linear adjusting movement.

The invention will be better understood and additional objects and advantages will become apparent from the following description taken in connection with the accompanying drawings.

DETAILED DESCRIPTION OF PREFERRED EMBODIMENTS

Figure 3:
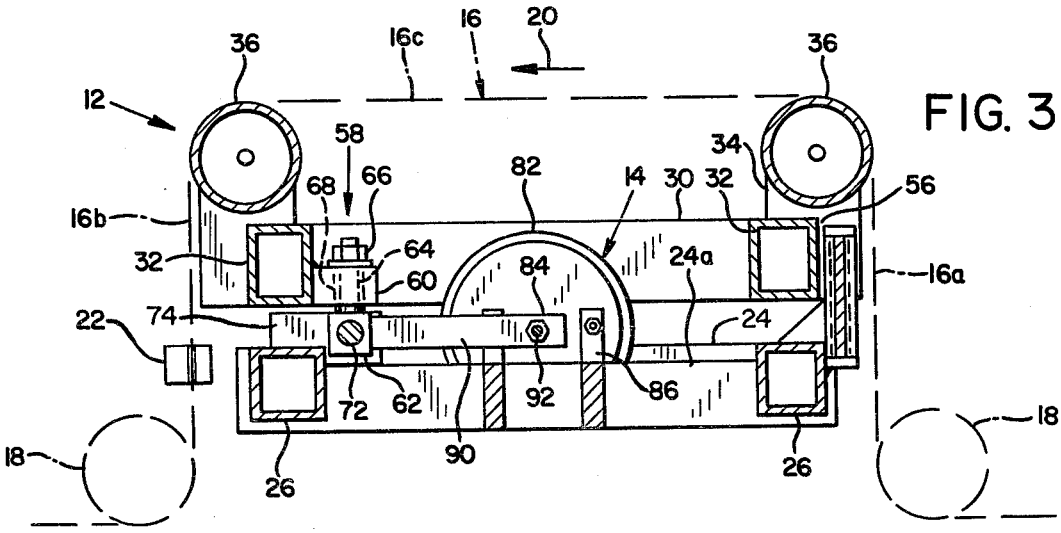
FIG. 3 is a cross sectional view taken on the line 3—3 of FIG. 2.

With reference to the drawings, the guiding assembly of the invention comprises in brief three main components. Such components include a base frame 10, an adjustable guide roller frame 12 mounted on the base frame for pivotal adjustment on a vertical axis, and actuator means 14 supported on the base frame and operatively connected to the guide roller frame for selectively positioning the latter pivotally relative to the base frame. The base frame 10 is arranged to be mounted in a selected position adjacent processing machines in which a web 16, FIG. 3, is being fed. The assembly is used with a pair of fixed guide rollers 18, FIG. 3, extending laterally of the assembly and disposed parallel with the base frame 10. The web moves in the direction of arrow 20 in FIG. 3, and the rollers 18 are arranged such that the entering and exiting spans 16*a* and 16*b*, respectively, of the web are parallel with each other and perpendicular to the plane of the guide movement span 16*c* over the guide roller frame 12. With the web moving across the span 16*c* and a 180° wrap over the guide, its path can be shifted by pivotal movement of the frame 12 on an axis perpendicular to span 16*c*.

The exiting span 16*b* is generally located closely adjacent to a processing machine, not shown, for the web 16, and such exiting span is associated with a sensor 22 of wellknown structure which senses the line of travel of the web and which is in a control system for the actuator means 14 of conventional structure. The elements of the present assembly have a novel structure and cooperate in a novel manner for correcting the line of travel of the web, as will now be described.

Base frame 10 includes suitable framing to provide integral connection to a support, not shown, adjacent processing apparatus for the web. Such framing comprises end angle members 24 which may be bolted or otherwise secured to the support, and laterally extending tubular frame members 26 integrated therewith into a sturdy rigid frame. The guide roller frame 12 includes end frame members 30 secured integrally to a pair of laterally extending, parallel tubular frame members 32 of approximately the same spacing as the base frame members 26. End frame members 30 have upwardly extending ears 34 to which a pair of laterally extending parallel rollers 36 are rotatably supported for free rotation. The frame 12 is of sufficient width to accommodate the width of the web and preferably has a substantial distance between the rollers 36 for efficient lateral correction of the travelling webs as will be more apparent hereinafter.

A portion of the support of guide roller frame 12 on the base frame 10 is by a fixed offset pivot assembly 40. This pivot assembly comprises a rigid post or pivot base 42 securely integrated with a base frame member 26, as by welding, adjacent the entering span portion 16*a* of the web. This post extends up into the plane of the adjacent guide roller frame member 32 and has top and bottom plates 44 secured thereto as by screws 46. Plates 44 project laterally beyond one side of the post 42 and support a pivot pin 48 therebetween. This pin provides journaled support for one end of a leaf spring support arm 50 secured integrally at its other end to one side of the adjacent guide roller frame member 32. This latter securement comprises a screw connection 52 to an upright spacer bar 54 welded to the member 32. As best seen in FIG. 3, a small clearance 56 is provided between the fixed pivot assembly and the adjacent side of frame member 32.

Support arm 50 is of heavy gauge spring steel or the like which will allow flexure of the arm in the direction of the moving span but at the same time has sufficient vertical rigidity to support the adjacent side of the guide roller frame 12 in a stable horizontal plane. For this purpose, arm 50 has a substantial vertical dimension, including the length of the pivot pin support, such dimension being correlated with the thickness of the metal, the length of the arm, and the flexure of the steel to provide a stable support both vertically and horizontally but at the same time capable of slight flexure under power from the actuator means, as will be more apparent hereinafter.

Guide roller frame 12 has a moving pivot connection 58 with the base. This pivot connection comprises a projection 60 integral with the inner side of the lateral frame member 32 which is opposite from the fixed pivot assembly 40. An extension 62 depends from the projection 60 in a rotatable connection thereto. Such rotatable support is by means of an upwardly extending shaft 64 on the extension having a threaded upper end for receiving a supporting, connecting nut 66. A spacer bushing 68 is provided around the shaft 64 to provide free rotation of the extension 62 upon tightening the nut.

The extension 62 has integral connected support on a hardened guide and support shaft or raceway 72, such as by a press fit, set screw, or the like. Shaft 72 is in turn supported at its opposite ends of the frame 10 by bearing blocks 74 secured to the frame in a stationary position, as by screws 76. Bearing blocks 74 preferably comprise conventional linear ball bushings which according to their known function allow substantial free friction movement of the hardened shaft 72 therethrough even though lateral thrusts may exist on such shaft such as the load on this portion of the guide roller frame.

The actuator 14, under the control of the sensor 22, is arranged to drive the shaft 72 in an axial direction, comprising a linear direction laterally of the base frame 10. In the present drawings, the actuator is shown as comprising diaphragm type having fluid pressure inlet and/or outlets 83 and actuators 82 of a well known type cooperating through a common shaft to provide pneumatic drive in both directions to impart pivotal movement of the guide roller frame 12 through the necessary arc in opposite directions. The actuators are secured, as by bolt connections 86, in a stationary position on a rigid cross frame member 24*a* which comprises an integral part of frame 10. It is to be understood that the actuator means may comprise a single acting diaphragm with spring return. Also, the actuator could comprise a cylinder-plunger type mechanism or an electromechanical mechanism. The output shaft 84 of the actuator or actuators is secured to the depending extension by a connecting arm 90. This arm comprises a rigid part of the extension 62, such as by being an integrally cast part thereof or a welded extension, and has secured connection to the output shaft 84 in a suitable manner such as by a double nut connection 92, best seen in FIG. 2. Shaft 84 is parallel with the shaft 72 and the arm 90 is disposed at right angles to these two members.

It is apparent that as the actuator 14 applies movement to shaft 84, projection 60 and its extension 62, and also the shaft 72, move as a unit with the actuator shaft. Such movement is linear across the frame 10 due to the guiding function of the shaft 72 in the bearing blocks 74 secured to the frame. When the moving pivot travels in its straight path, the guide roller frame 12 is caused to rotate on its fixed pivot assembly 40. Since the moving pivot comes in a straight line instead of on a path common with the radius of pivot 40, the distance between the two pivots must change slightly. This change in distance is absorbed by a slight flexing of the arm 50.

Figure 4:
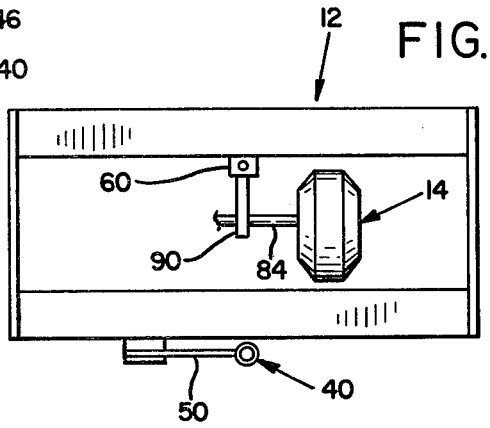
FIGS. 4, 5 and 6 are diagrammatic plan views illustrating operating positions of the guide rollers frame.
Figure 5:
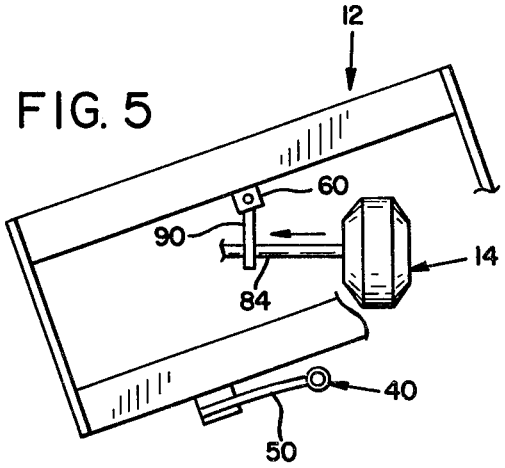
Figure 6:
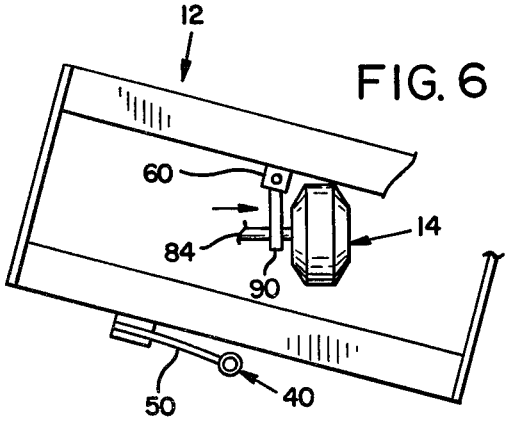

FIGS. 4, 5 and 6 show the relationship of parts in the above adjustable concept. In FIG. 4, the parts are at rest or at least in a position wherein the guide roller frame is held in a normal centered position. With reference first to FIG. 6 and also to the broken lines in FIG. 2, when the actuator 14 drives its shaft 84 in a retracting movement as in FIG. 6, or away from the supporting end of the arm 50, FIG. 2, the frame 10 will pivot clockwise on its fixed pivot 40. When the actuator drives its shaft in the other direction, the frame 10 is pivoted counterclockwise as seen in FIG. 5. The arm 50 will flex to allow the necessary pivotal adjustment. Such pivoted adjustment of the guide roller frame 12 changes the path of the traveling web.

Figure 2:
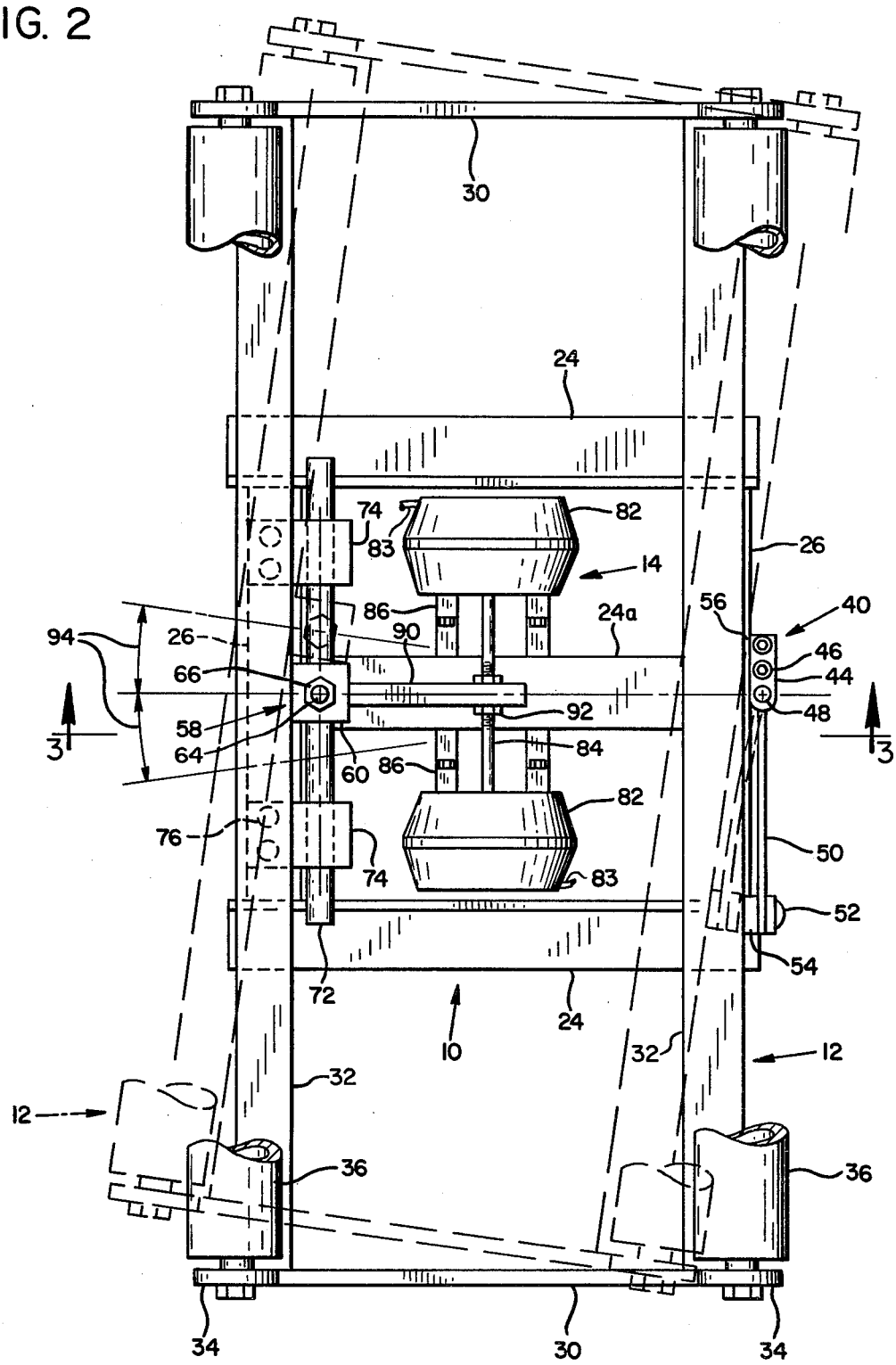
FIG. 2 is an enlarged top plan view of the assembly, a portion of this view also being broken away and also showing a broken line adjusting position thereof.

As viewed in FIG. 2, arrows 94 define the beta angle of adjustment of the pivot 40 which exists at the roller 36 on the exiting span side of the assembly. The span between rollers 36 is wide so that less beta angle is required for the necessary correction. Such comprises one important feature of the invention.

Also according to the invention, a displacement-type guiding assembly is provided that has a stable support for a guide roller frame and pivot drive thereof and at the same time utilizes connectors and supports which develop only a minimum of friction in the adjustable movement. The support for the roller guide frame 12 is at three points on the base frame 12, namely, at the attached end of arm 50 and at the two bearing points 74. Since the moving pivot 58 travels in a straight line instead of in an arc, the actuator 14 can be rigidly attached to both the base and the moving pivot, thus eliminating the necessity of pin connections or intermediate linkages. The guide moves with very little force, thus minimizing the extent of power for the actuator and providing a more responsive system. The direct connection of the actuator with the guide roller frame 12 allows the latter to operate with great speed and accuracy. At the same time, the three point support holds the frame 12 in a stable position in the plane of the moving web without the necessity of outboard bearings. An additional advantage of the present assembly is that it is simplified in structure, economical to manufacture and easy to maintain. It uses readily available or easily manufactured parts and the wear parts are easily accessible for repair or service.

Figure 1:
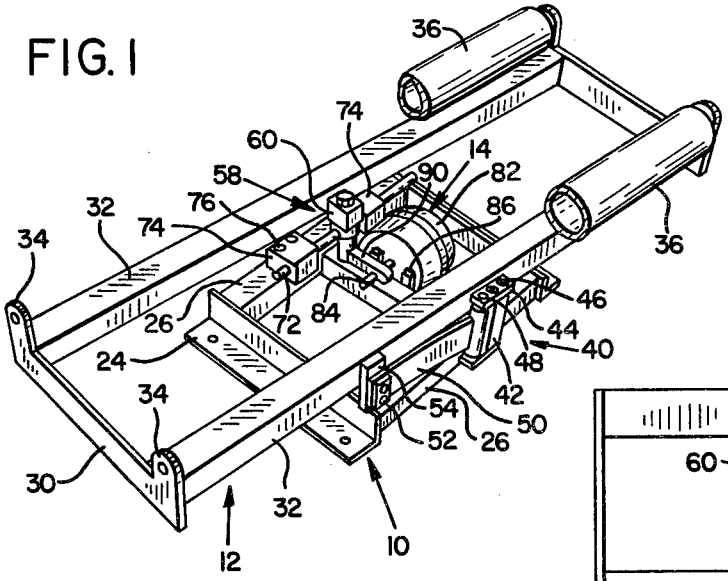
FIG. 1 is a perspective view of a displacement-type guiding assembly embodying features of the invention, a portion of this assembly being broken away for clarity.

It is to be understood that the forms of my invention herein shown and described are to be taken as preferred examples of the same and that various other changes in the shape, size and arrangement of parts may be resorted to without departing from the spirit of my invention, or the scope of the subjoined claims. For example, the actuator shaft 84 in the FIG. 1 embodiment may have a length such that it can be connected to one end of the shaft 72 outside of the area between the bearings 74 rather than to the pivot extension between these bearings as shown. Also, in the fixed pivot 40, it is to be understood that the pivot end 48 can be integrated with the guide roller frame assembly 12 and the second end at 54 can be integrated with the base frame 10 with the same results.

Having thus described my invention, I claim:

1. An offset pivot displacement-type guiding assembly for controlling the path of travel of a web comprising a base frame, a guide frame overlying said base frame and having a pair of spaced, parallel guide rollers which are arranged with their axes extending across the line of travel of a moving web and which receive the traveling web over the surface thereof from an entering span at one end of said rollers and an exiting span at said other roller, the span between said rollers comprising a guide movement span, a fixed offset pivot support supporting said guide frame pivotally on said base frame in an area adjacent the entering span of said rollers, said fixed pivot support being flexible in the direction of travel of the guide movement span of the web, a movable pivot support supporting said guide frame on said base frame in an area adjacent the exiting span of said rollers, said movable pivot support having a movable portion confined to linear movement with the relative travel between the linear movement thereof and the arc of said fixed pivot support being absorbed by a flexure in said fixed pivot support, and actuator means on said base frame operatively secured to said movable portion for driving it in said linear movement.

2. The guiding assembly of claim 1 wherein said fixed pivot support comprises a pivot base secured integrally to one of said base member and said guide frame, and a laterally extending arm pivotally supported on said pivot base and secured at an outer end thereof to the other of said base member and said guide frame, said arm having sufficient rigidity in the direction parallel with the pivot axis of said fixed pivot support for stable support of an adjacent portion of said guide frame but having flexibility at right angles to said pivot axis to allow for said flexure.

3. The guiding assembly of claim 1 wherein said movable portion of said moving pivot support comprises a pivot shaft supported on said guide frame, and guide means on said base member operatively engageable with said movable pivot support to provide said linear movement thereof.

4. The guiding assembly of claim 1 wherein said movable portion of said moving pivot support comprises a pivot shaft supported on said guide frame, a pair of laterally spaced bearings on said base frame, said movable portion of said moving pivot support also including a shaft integral with said pivot shaft and having movable guided support in said bearings.

5. The guiding assembly of claim 1 wherein said fixed pivot support comprises a pivot base secured integrally to said base member, and a laterally extending arm pivotally supported on said pivot base and secured at an outer end thereof to said guide frame, said arm having sufficient rigidity in the direction parallel with the pivot axis of said fixed pivot support for stable support of an adjacent portion of said guide frame but having flexibility at right angles to said pivot axis to allow for said flexure, said movable portion of said moving pivot support comprising a pivot shaft supported on said guide frame, and guide means on said base member operatively engageable with said movable pivot support to provide said linear movement thereof.

6. The guiding assembly of claim 1 wherein said fixed pivot support comprises a pivot base secured integrally to said base member, and a laterally extending arm pivotally supported on said pivot base and secured at an outer end thereof to said guide frame, said arm having sufficient rigidity in the direction parallel with the pivot axis of said fixed pivot support for stable support of an adjacent portion of said guide frame but having flexibility at right angles to said pivot axis to allow for said flexure, said movable portion of said moving pivot support comprising a pivot shaft supported on said guide frame, a pair of laterally spaced bearings on said base frame, said movable portion of said moving pivot support also including a shaft integral with said pivot shaft and having movable guided support in said bearings.

7. The guiding assembly of claim 1 wherein said guide frame includes end frame members and a pair of parallel lateral frame members integrated therewith, said fixed pivot support having a supported engagement with one of said lateral frame members and said movable pivot support having a supported engagement with the other of said lateral frame members.

8. The guiding assembly of claim 1 wherein said actuator comprises a fluid operated assembly having an output shaft secured to the movable portion of said movable pivot support.

9. The guiding assembly of claim 1 wherein said actuator comprises a double acting drive member.

10. An offset pivot displacement-type guiding assembly for controlling the path of travel of a web comprising a base frame, a guide frame overlying said base frame, said guide frame having lateral frame means supporting a pair of spaced, parallel guide rollers which are arranged with their axes extending across the line of travel of said moving web and which receive the traveling web over the surface thereof from an entering span at one of said rollers and an exiting span at said other roller, the span between said rollers comprising a guide movement span, a fixed offset pivot mounted on said base and having a flexible arm extending laterally from said pivot and secured adjacent its outer end to said guide frame adjacent to the entering span of said rollers for pivotally supporting said guide frame, a moving pivot assembly disposed adjacent to the exiting span of said rollers, said moving pivot assembly comprising a laterally extending support shaft mounted on said base frame for linear movement, said moving pivot assembly also comprising projection means integral with said guide frame, a pivot shaft pivotally supported in said projection means and depending from said projection means, means securing said pivot shaft to said support shaft whereby said projection means is restricted to linear movement, the relative travel between the linear movement thereof and the arc of said fixed pivot being absorbed by a flexing of said arm, and actuator means on said base frame secured to said pivot shaft for driving said support shaft to provide pivot adjusting movement of said guide frame.

* * * * *